United States Patent [19]

Overfield et al.

[11] Patent Number: 4,775,299

[45] Date of Patent: Oct. 4, 1988

[54] VARIABLE CLEARANCE POCKET PISTON POSITIONING DEVICE

[75] Inventors: Norbert W. Overfield; Richard W. Erickson, both of Corry, Pa.

[73] Assignee: Cooper Industries, Inc., Houston, Tex.

[21] Appl. No.: 902,244

[22] Filed: Aug. 29, 1986

[51] Int. Cl.[4] ..... F04B 49/00

[52] U.S. Cl. ..... 417/274; 92/60.5

[58] Field of Search ..... 417/274–276; 92/60.5

[56] References Cited

U.S. PATENT DOCUMENTS

| | | | |
|---|---|---|---|
| 2,570,965 | 10/1951 | Meyers | 417/274 |
| 2,711,697 | 6/1955 | Gibbs | 417/274 |
| 3,524,387 | 8/1970 | Britvia | 92/60.5 |
| 3,816,028 | 6/1974 | Schouteeten | 417/274 |
| 3,838,941 | 10/1974 | Roschupkin | 417/276 |

FOREIGN PATENT DOCUMENTS

| | | | |
|---|---|---|---|
| 197710 | 10/1977 | U.S.S.R. | 417/274 |
| 1232271 | 5/1968 | United Kingdom | 417/275 |

*Primary Examiner*—William L. Freeh

*Attorney, Agent, or Firm*—Roger L. Maxwell; Eddie E. Scott; Alan R. Thiele

[57] ABSTRACT

A clearance pocket having a housing attached to a cylinder of the compressor. In one embodiment, in which the housing has a sidewall and a distal wall and includes a clearance chamber with a passageway extending between the cylinder head and the clearance chamber, the pocket also has a piston movably located in the clearance chamber in slidably sealing engagement with the interior sidewall of the housing, and means for providing fluidic communication between the cylinder head and that portion of the clearance chamber between the piston and the distal wall of the housing. In another embodiment, in which the housing also includes a second clearance chamber with a second passageway extending between the first and second clearance chambers, the pocket also has a second piston movably located in the second clearance chamber in slidably sealing engagement with the interior wall of the housing; means for fixedly separating the first piston and the second piston so that they move freely in unison means for providing fluidic communication between the cylinder head and that portion of the first clearance chamber between the first piston and the effectively closed second passageway; and controllable means for establishing fluidic communication between that portion of the second clearance chamber between the second piston and the effectively closed second passageway and that portion of the clearance chamber between the second piston and the distal wall of the housing.

1 Claim, 3 Drawing Sheets

VARIABLE CLEARANCE POCKET PISTON POSITIONING DEVICE

BACKGROUND OF THE INVENTION

1. Field of the Invention

This invention relates generally to improved clearance pockets for compressors and the like. More particularly, this invention relates to an improved variable volume clearance pocket wherein the volume is controlled by fluid means driven by forces generated by the operating compressor.

2. Description of the Prior Art

Previously proposed arrangements of clearance pockets are illustrated in U.S. Pat. No. 1,867,681 to Simson, U.S. Pat. No. 3,084,847 to Smith, U.S. Pat. No. 3,415,441 to Kehler, and U.S. Pat. No. 3,972,652 to Minnicino. Each of the foregoing illustrate arrangements having structure significantly and materially different from the variable clearance pocket of the present invention and/or do not teach or disclose volume control by fluid means and/or do not teach or disclose use of forces generated by the compressor for volume varying motive force. Accordingly, each of the foregoing lacks one or all of the considerable advantages of the present invention, which advantages result from integration of the aforementioned structure and teachings into an improved system having a variable clearance pocket. These advantages include simplicity of structure, continuously variable volume, allowability of volume variation during system operation, ready adaptability for remote control, and obviation of a requirement for additional power supply within the system.

SUMMARY OF THE INVENTION

The variable volume apparatus of the present invention, said apparatus being adaptable for incorporation into fluid compressing systems wherein a time varying pressure is developed in a cylinder head, possesses the aforementioned advantages by having a hollow housing connected in communication with the compression cylinder, said housing having a sidewall and a distal wall and including a clearance chamber with a passageway extending between the cylinder head and the clearance chamber; a pressure-responsive piston movably located in the clearance chamber in slidably sealing engagement with the interior sidewall of the hollow housing; and means for providing fluidic communication between the cylinder head and that portion of the clearance chamber between the piston and the distal wall of the hollow housing.

Accordingly, it is an object of this invention to provide an improved variable clearance pocket or apparatus for compressors that is controlled by fluid means, the motive force which is inherently developed by the compressor during typical compressor operation.

Another object of this invention is to provide an improved variable volume clearance apparatus having a positionable piston, said apparatus capable of being quickly and easily set to the desired volume without requiring manual positioning of the piston.

Yet another object of this invention is to provide an improved variable volume clearance apparatus that can be quickly and readily set to the desired volume during full operation of the system in which the apparatus is incorporated.

Yet still another object of this invention is to provide an improved variable volume clearance apparatus that derives its motive force entirely from the system in which the apparatus is incorporated.

A further object of this invention is to provide an improved variable volume clearance apparatus that is readily adaptable for remote control.

Other objects, advantages, and new features of this invention will become apparent from the following detailed description of the invention when considered in conjunction with the accompanying drawings.

DETAILED DESCRIPTION OF THE PREFERRED EMBODIMENT

Figure 1:
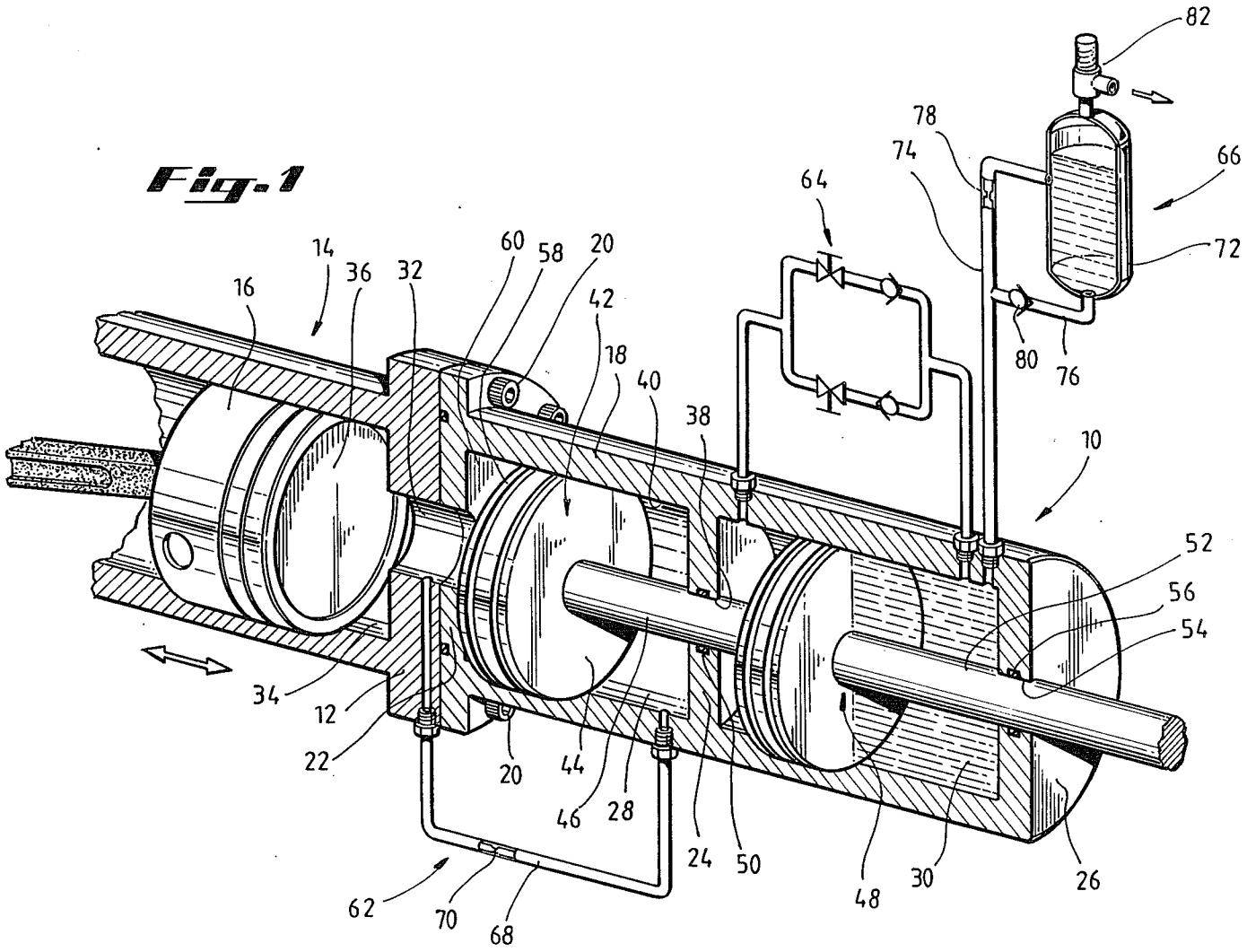
FIG. 1 is a cross-sectional view, partially schematic, that illustrates the portion of the compressor having a variable volume clearance apparatus constructed in accordance with the invention connected thereto.

Referring now to the drawings wherein like reference characters designate identical or corresponding parts throughout the several views and more particularly to FIG. 1, shown therein and generally designated by the reference character 10 is a variable volume clearance apparatus illustrated as being attached to a cylinder 12 of a compressor 14. A piston 16 is mounted in the compressor 14 for reciprocal movement.

The variable volume clearance apparatus 10 includes a hollow housing 18 mounted on the cylinder 12 by bolts 20 or other suitable connecting means. The housing includes spaced partitions 22, 24 and a distal end 26 to divide the housing 18 into a first clearance chamber 28 and a second clearance chamber 30. A passageway 32 extends through partition 22 and a cylinder 12 providing fluidic communication between a cylinder head 34 of the compressor 14, that is, the chamber defined by face 36 of piston 16 and cylinder 12, and the first clearance chamber 28. Another passageway 38 extends through partition 24 providing fluidic communication between first clearance chamber 28 and second clearance chamber 30 in the absence of any obstruction.

Movably disposed in the first clearance chamber 28 in slidably sealing engagement with the interior sidewall 40 of the housing is a pressure responsive piston 42 including a fitting portion 44 and a rod portion 46 projecting from fitting portion 44. Rod portion 46, in the embodiment of FIG. 1, extends through passageway 38 into the second clearance chamber 30 where it is welded or otherwise suitably connected to a second piston 48 to fixedly separate piston 48 from piston 42 and provide a means by which those pistons 42, 48 can reciprocably move in unison within their respective chambers 28, 30. As an alternative to connecting two pistons, fitting portion 44 and rod portion 46 of piston 42 and similar portions, as provided, of piston 48 could be formed as an integral unit whereby desired fixed separation and movability in unison could still obviously be achieved. If so formed, 46 would more clearly designate a middle portion, if you will, between fitting portions of an integral element. Regardless of whether 46 is a piston rod or a middle portion of an element having two fitting portions, means are included within apparatus 10 to preclude fluid flow from either clearance chamber 28, 30 to the other when element 46 extends through passageway 38. In the embodiment of FIG. 1, this means comprises partition 24, inherently, and sealing means 50 encircling element 46 where it extends through passageway 38.

The embodiment of FIG. 1 also has a portion of apparatus 10 designated by the reference character 52. Reference character 52, in a somewhat similar manner as reference character 46, could designate a rod of piston 48 or a projecting end portion of an integral body also comprising two fitting portions having a middle portion therebetween. In FIG. 1, portion 52 is shown to extend through a passageway 54 through distal wall 46 with sealing means 56 included in apparatus 10 to preclude escape of fluid from clearance chamber 30 through passageway 54 around portion 52. That portion 52 which extends out of housing 18 could be useful as a means engaging location of pistons 42 and 48 within their respective chambers. Reference marks could be placed on that portion of portion 52 which could extend out of housing 18 to enhance its usefulness as a gauge.

Face 58 of piston or fitting portion 42 and housing 18 define a pocket 60 in continual association with cylinder head 34 via passageway 32. As amount of power absorbed and the compressed gas delivered by a reciprocating compressor like compressor 14 is determined by, in part, the volume of compressed gas in cylinder head 34 and pocket 60, it is desirable to control the volume of pocket 60, which volume, it should be evident, can readily be controlled by controlling the position of fitting portion 42.

In order to control position of piston or fitting portion 42, the variable volume clearance apparatus 10 is provided with a fluid controlled system. There are three major portions of the fluid control system, those portions indicated generally by reference characters 62, 64, and 66. Portion 62 comprises means, such as a conduit 68, for allowing fluid flow between area 34 and 60 and that area within clearance chamber 28 defined by housing 18, portion 42, portion 46, and partition 24. For reasons set forth in greater detail below, the means such as conduit 68 must include fluid restricting means, such as an orifice 70, intermediate its ends at the areas it interconnects. Portion 64 comprises controllable means for establishing fluidic communication between that portion of the second clearance chamber 30 between portion 48 and sealed passageway 38 and that portion of the second clearance chamber 30 between portion 48 and sealed passageway 54. In FIG. 1 this means is illustrated by a conduit-formed two-branched circuit having a shut-off valve and a check valve in each branch, the check valve oriented to allow opposing flow in the two branches. Portion 66, which anticipates presence of a hydraulic fluid in clearance chamber 30, is a conventional makeup/compensation/vapor removal system, which comprises such well known elements that further description is not deemed necessary here beyond identifying low pressure tank 72, conduit 74, 76, orifice 78, check valve 80 and relief valve 82.

OPERATION OF THE PREFERRED EMBODIMENT

Figure 2:
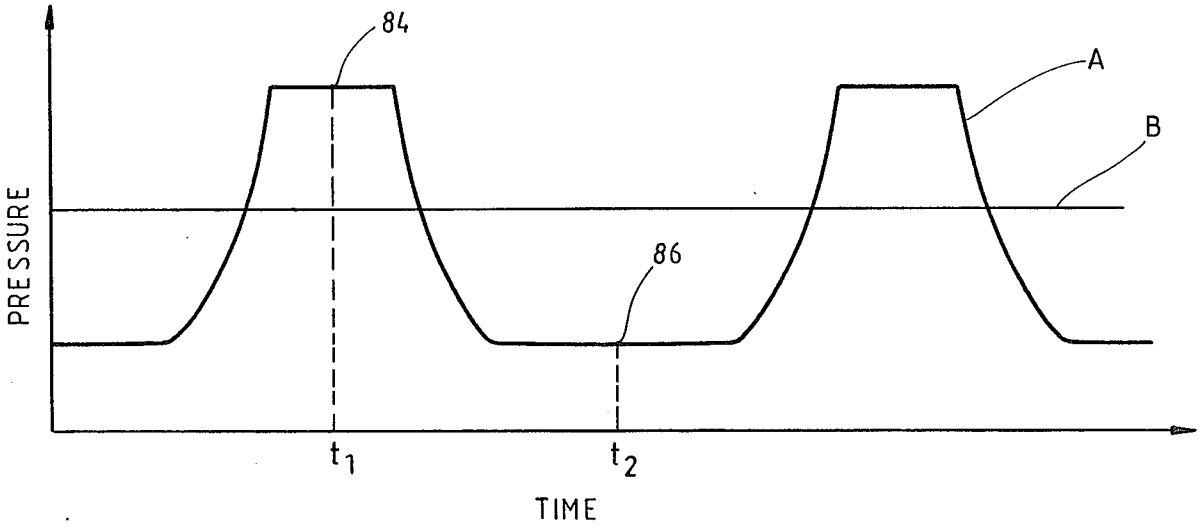
FIG. 2 is a graph illustrating value of various pressures developed within the system of the present invention, from which pressures the apparatus of the present invention is driven.

As is well known, the pressure on a working gas compressor cylinder head varies continuously. A typical plot of this characteristic with respect to time is illustrated by curve A in FIG. 2. Because the apparatus of the present invention has portion 62; which portion includes an orifice 70 which may be sized to permit a small amount of gas to flow through conduit 68 from area 34 and 60 to that area within clearance chamber 28 defined by housing 18, portion 42, portion 46, and partition 24 when the cylinder head pressure is high, as at the time $t_1$ corresponding to point 84, and to permit a small amount of gas to flow in the opposite direction when cylinder head pressure is low, as at the time $t_2$ corresponding to point 86; means are included within apparatus 10 which, by their heretofore described structure, cause a generally constant pressure, with a value intermediate the high and low values of the time varying pressure in the cylinder head, to develop in that area within clearance chamber 28 defined by housing 18, portion 42, portion 46, and partition 24. A typical plot of the pressure with respect to time is illustrated by line B in FIG. 2.

The motive force of the present invention is derived from the facts that at those times when the time varying pressure is greater than the constant pressure, i.e., at times when the function defining curve A generates a value greater than the function defining line B, an outward (that is, away from compressor 14) force is exerted on piston 42 and at those times when the time varying pressure is less than the constant pressure, i.e., at times when the function defining curve A generates a value less than the function defining line B, an inward (that is, toward compressor 14) force is exerted on piston 42. The force on piston 42 is transmitted through the rigid connection 46 to the piston 48 where it causes time varying pressure to develop in the fluid on both sides of piston 48.

The apparatus of the present invention uses the motive force described above and the pressures produced by those forces by means such as means 64 in association with the structure forming in elements within clearance chamber 30, including hydraulic or other incompressible fluid within said chamber 30. If it is desired to lock the position of piston 42, both shut-off valves in the branch circuit of portion 64 could be closed. Amount of incompressible fluid on opposite sides of the fitting portion of portion 48 would thus be fixed; portion 48 could not move;nor could piston 42 move as it is fixedly separated from portion 48. If, on the other hand, it is desired to move piston 42 in one direction or the other, the shut-off valve in series with one or the other check valve could be opened to permit fluid; driven by the motive force acting on piston 42, which force is transmitted to the fitting portion of portion 48 by a rod or middle portion 46; to flow from one side of clearance chamber 30 to the other, those sides being the two areas within chamber 30 on either side of the fitting portion of portion 48. By such means the fitting portion of portion 48 would be moved and piston 42 fixedly separated from that fitting portion, would be moved also. It should be appreciated that once piston 42 attains the desired position, it can be locked by closing the two shut-off valves in portion 64 as described above.

Portion 66, the makeup/compensation/vapor removal system, operates in a manner well known to those skilled in the art to avoid such problems as fluid loss, vapor buildup, and thermal expansion of fluid within chamber 30, and is included in the embodiment of FIG. 1 to complete disclosure of the preferred embodiment of the present invention.

DESCRIPTION OF THE EMBODIMENT OF FIGS. 3 AND 4

Figure 4:
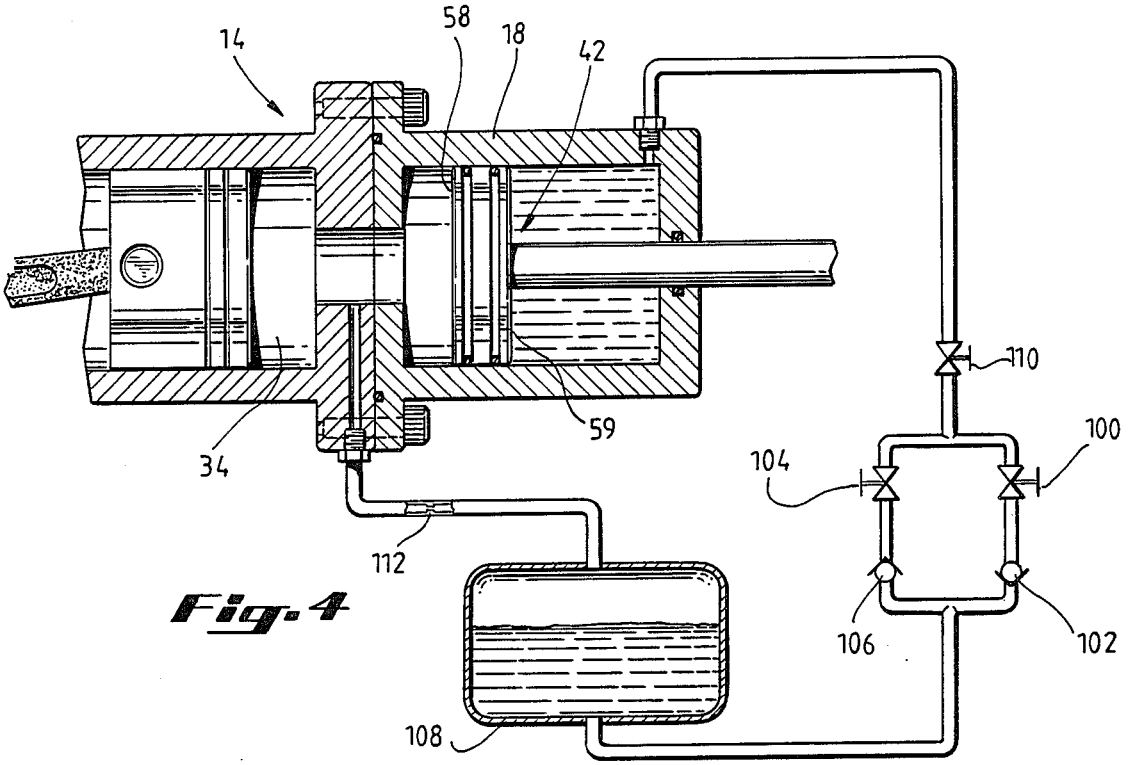
FIG. 4 is a cross-sectional view, partially schematic, that illustrates a portion of a compressor having yet another embodiment of the variable volume clearance apparatus of the present invention connected thereto.
Figure 3:
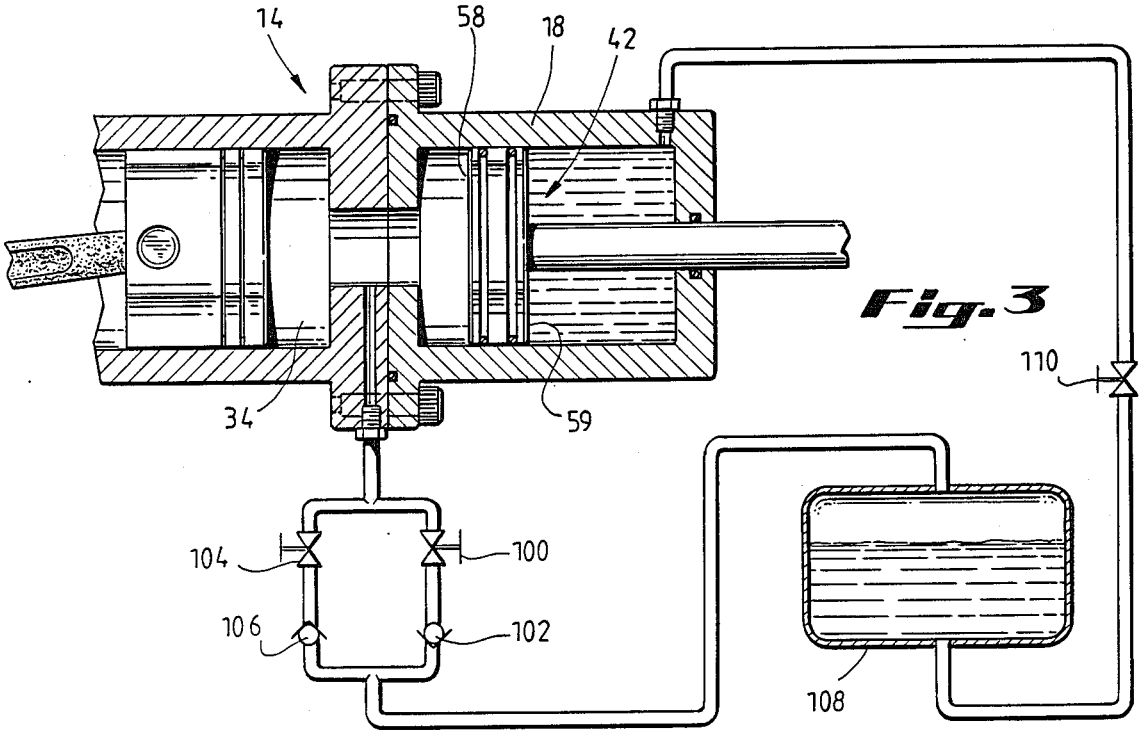
FIG. 3 is a cross-sectional view, partially schematic, that illustrates a portion of a compressor having another embodiment of the variable volume clearance apparatus of the present invention connected thereto.

FIGS. 3 and 4 illustrate alternative embodiments of the variable volume clearance apparatus of the present invention connected to relevant portions of a compressor 14. The embodiments of FIGS. 3 and 4 differ from the preferred embodiment in that housing 18 includes only one clearance chamber, in which chamber are effectively perform the functions performed in both chambers of the preferred embodiment by means 62 and 64. In these embodiments face 58 of piston 42 is exposed to the gas within the compressor head 34 and the backside 59 of piston 42 is exposed to relatively incompressible hydraulic fluid. If, for example, it is desired to reposition piston 42 in the embodiment of FIG. 3 to the right, shut-off valve 100 could be opened. This opening would complete a gas circuit from the top of a partially filled supply tank 108 through check valve 102 to cylinder head 34. If the pressure in tank 108 is higher than the lowest pressure in cylinder head 34 some gas will flow from the hydraulic supply tank to the working cylinder and the pressure in the tank 108 will approach cylinder suction pressure. Recognizing that the pressure in the hydraulic fluid in clearance chamber 28 closely follows the dynamic pressure variations in the cylinder head 34, when valve 110 is opened, a hydraulic fluid flow path is established between the hydraulic portion of chamber 28 and the bottom of the hydraulic tank 108. During that portion of the compressor cycle where cylinder pressure exceeds suction pressure a hydraulic gradient will be established between the hydraulic portion of chamber 28 and hydraulic tank 108. Fluid will therefore flow from the hydraulic portion of chamber 28 to the hydraulic supply (return) tank 108 and the variable clearance pocket piston 42 will move to the right. When piston 42 is in its new desired position, valve 110 can be shut and the piston then locked in its new position. To move the piston to the left a similar sequence is followed except valve 104 is opened and check valve 106 permits the pressure and hydraulic supply tank 108 to approach maximum compressor cylinder pressure rather than minimum. When valve 110 is open the hydraulic flow will then be established from the hydraulic supply tank 108 to the hydraulic portion of chamber 28 of the variable pocket causing the piston to move to the left.

The embodiment of FIG. 4 retains all of the components of the embodiment of FIG. 3 and adds but additional component, orifice 112, located in the cylinder to hydraulic supply tank line to restrict fluid flow along the line of and with similar effect as orifice 70. Although the relative position of major elements are altered somewhat in this embodiment as compared to the embodiment of FIG. 3 operation is virtually identical.

Obviously, numerous modifications and variations of the present invention are possible in light of the above teachings. It is therefore to be understood that in the scope of the appended claims, the present invention may be practiced otherwise as specifically described hereinabove.

We claim:

1. A variable volume clearance apparatus for compressors or the like that include a compressor cylinder having a cylinder head wherein a time varying pressure is developed comprising;

a hollow housing connected in communication with the compression cylinder, said housing having a sidewall and a distal wall and including first and second clearance chambers, a first passageway extending between the cylinder head and the first clearance chamber, and a second passageway extending between the first and second clearance chambers;

a first pressure responsive piston movably located in the first clearance chamber in slidably sealing engagement with the interior sidewall of the hollow housing;

a second pressure responsive piston movably located in the second clearance chamber in slidably sealing engagement with the interior sidewall of the hollow housing;

means for fixedly separating the first pressure responsive piston and the second pressure responsive piston so they move freely in unison, said means effectively closing the second passageway;

means for providing fluidic communication between the cylinder head and that portion of the first clearance chamber between the first pressure responsive piston and the effectively closed second passageway; and controllable means for establishing fluidic communication between that portion of the second clearance chamber between the second pressure responsive piston and the effectively closed second passageway and that portion of the clearance chamber between the second pressure responsive piston and the distal wall of the hollow housing, said means adapted to allow control of the allowable direction of fluid flow between the two portions when communication is established.

* * * * *